US006549086B2

(12) United States Patent
Kawanami

(10) Patent No.: US 6,549,086 B2
(45) Date of Patent: Apr. 15, 2003

(54) NONRECIPROCAL CIRCUIT DEVICE WITH A BALANCED PORT AND COMMUNICATION DEVICE INCORPORATING THE SAME

(75) Inventor: Takashi Kawanami, Nonoichi-machi (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/053,782

(22) Filed: Jan. 22, 2002

(65) Prior Publication Data

US 2002/0153963 A1 Oct. 24, 2002

(30) Foreign Application Priority Data

Jan. 24, 2001 (JP) ..... 2001-016126
Nov. 16, 2001 (JP) ..... 2001-351946

(51) Int. Cl.[7] ..... H01P 1/36; H01P 1/383

(52) U.S. Cl. ..... 333/1.1; 333/24.2

(58) Field of Search ..... 333/1.1, 24.2; H01P 1/362, 1/383

(56) References Cited

U.S. PATENT DOCUMENTS 3,614,675 A * 10/1971 Konishi ..... 333/24.2
3,836,874 A * 9/1974 Maeda et al. ..... 333/1.1
5,793,253 A * 8/1998 Kumar et al. ..... 330/124 R

* cited by examiner

*Primary Examiner*—Justin P. Bettendorf
(74) *Attorney, Agent, or Firm*—Keating & Bennett, LLP

(57) ABSTRACT

The present invention provides a communication apparatus incorporating a nonreciprocal circuit device capable of being connected to a balanced output circuit without interposing a balun, a hybrid, or the like therebetween. The nonreciprocal circuit device includes an assembly formed of three central conductors. On the upper surface of a disk-shaped microwave ferrite member, the central conductors are arranged intersecting each other at an angle of approximately 120 degrees in a mutually electrically insulated manner. The second and third central electrodes have connecting portions at first ends thereof and the second ends thereof are connected to a ground electrode. The first central electrode has connecting portions at both ends thereof. The connecting portions of the first central electrode serve as feeding ends. An input port provided by the ends of the first central electrode serves as a balanced input port. An output port connected to the second central electrode serves as an unbalanced output port. Another port connected to the third central electrode serves as a terminating port.

12 Claims, 10 Drawing Sheets

NONRECIPROCAL CIRCUIT DEVICE WITH A BALANCED PORT AND COMMUNICATION DEVICE INCORPORATING THE SAME

BACKGROUND OF THE INVENTION

1. Field of the Invention

The present invention relates to nonreciprocal circuit devices such as isolators and circulators used in microwave bands and the like, and also relates to communication apparatuses incorporating the nonreciprocal circuit devices.

2. Description of the Related Art

Hitherto, a balun, a hybrid circuit, or a power synthesizer has been interposed on the output side of a balanced output circuit, particularly, on the output side of a push-pull amplifier having a pair of amplifiers driven with a phase difference of 180 degrees. With the balun or the like, a balanced signal has been converted into a single ended (unbalanced) signal.

In general, a balun can be used for the HF band, the VHF band, the UHF band and lower. On the other hand, in the UHF band (about 300 MHz–3 GHz), a hybrid circuit or a power synthesizer can also be used. In the case of a balun, a broadband ferrite core is often used. In this case, the usable highest frequency band is the UHF band. Usually, since both the hybrid circuit and the power synthesizer are distributed constant circuits, there is no practical problem with the use of the hybrid or the power synthesizer above the UHF band.

In the transmission circuit section of a communication apparatus, particularly in the transmission circuit section for QPSK modulation including an amplitude modulating component and in a transmission circuit section requiring high reliability, a transmission signal converted into a single ended signal passes through an isolator and then is transmitted to an antenna via an antenna switching device (or an antenna duplexer). In the case the isolator is not inserted in the transmission circuit, reflection from the antenna, the antenna duplexer, or the like returns to a balanced output circuit (particularly, an amplifier). Consequently, this changes load impedance viewed from the balanced output circuit. When the load impedance changes, the waveform of the transmission signal is greatly deformed. In addition, the amplifier s operation becomes unstable and oscillation occurs.

However, as in the case of the related art, when a balun, a hybrid circuit, or a power synthesizer is combined with an isolator, the transmission circuit section becomes larger and more expensive. This doesn't meet the recent demand for miniaturization and cost reduction of a mobile communication apparatus. Furthermore, since a transmission signal passes through both the balun and the isolator, insertion loss increases. In addition, since a large amount of power flows in the transmission circuit section, many kinds of device are, generally speaking, necessary to safely and correctly control the power. Thus, unnecessary radiation tends to occur, which often causes mutual interference between the components inside the communication apparatus. Additionally, since the operational frequency bandwidth of the transmission circuit section is narrowed by the operational frequency bandwidths of both of the balun and the isolator, the usable frequency band becomes narrower.

In addition to the above problems, in the communication apparatus, in order to prevent the emission of second and third harmonic waves from a power amplifier, a low pass filter or a band pass filter is often included in addition to the isolator, to suppress a harmonic wave signal to a level of approximately −60 dB with respect to the fundamental wave ratio. However, in such a circuit structure, the size, the cost, and the insertion loss increase. Thus, it is desirable for the isolator to suppress harmonic waves effectively, thus avoiding the need for a filter.

It is known that an isolator can effectively suppress harmonic waves at frequencies higher than an operational frequency (fundamental wave). Particularly, the signals of waves deviating far from the fundamental wave, such as the signals of a third harmonic wave, can be sufficiently attenuated, for example, by 30 to 40 dB or more. However, primarily, an isolator is not generally used as a filter. Thus, the signals of frequencies relatively close to the fundamental wave, such as a frequency signal of a second harmonic wave, are attenuated by only 15 to 25 dB. This is not sufficient attenuation when compared with the attenuation of the third harmonic wave signals.

In a usual unbalanced (single ended) output amplifier, second harmonic wave signals are stronger (approximately −30 dB below the fundamental wave) than third harmonic wave signals (approximately −40 dB below the fundamental wave). Thus, when using only an isolator, the second harmonic wave signals cannot be sufficiently attenuated (approximately −50 dB below the fundamental wave). As a result, a filter is often needed to attenuate the second harmonic wave signals to be at −60 dB or lower with respect to the fundamental wave.

However, characteristically, in the balanced-type (push-pull) amplifier, such a second harmonic wave does not occur so often (example: approximately from −40 to −50 dB below the fundamental wave). Thus, it is more problematic to suppress a third harmonic wave (approximately −40 dB below the fundamental wave). On the other hand, since the isolator is highly capable of suppressing the third harmonic wave, as mentioned above, by combining the balanced amplifier and the isolator, the third harmonic wave will be sufficiently suppressed to approximately −60 dB below the fundamental wave without adding a filter (the second harmonic wave doesn't become so big a problem because it rarely occurs in the balanced-type amplifier as described above). However, in the case of the related art, it is necessary to interpose a balun between the isolator and the balanced-type amplifier. (All of the conventional isolators have only unbalanced ports. Therefore a balun is inherently necessary in order to connect a conventional isolator and a balanced-type amplifier which have different types of ports.)

SUMMARY OF THE INVENTION

To address these issues, the present invention provides a nonreciprocal circuit device capable of being connected directly to a balanced output circuit without interposing therebetween a balun, a hybrid circuit, or the like. The invention further provides a communication apparatus incorporating the nonreciprocal circuit device.

To this end, according to a first aspect of the present invention, there is provided a nonreciprocal circuit device including a plurality of ports, a permanent magnet, a ferrite member to which the permanent magnet applies a DC magnetic field, and a plurality of central electrodes arranged on the ferrite member. In the nonreciprocal circuit device, at least one of the plurality of ports connected to the central electrodes is a balanced port. More specifically, both ends of the central electrode corresponding to the balanced port may be feeding ends. Preferably, each of the central electrodes corresponding to has an electric length of substantially ½ wavelength.

The nonreciprocal circuit device having the above structure can be connected directly to the output side of the balanced output circuit without interposing a balun, a hybrid circuit, or the like.

In addition, in order to obtain impedance matching between the nonreciprocal circuit device and the balanced output circuit connected thereto, for example, a matching capacitor may be electrically connected in series to each end of the central electrode of the balanced port, a matching capacitor may be electrically connected between the two ends of the central electrode of the balanced port, or a matching capacitor may be electrically connected between each end of the central electrode of the balanced port and a ground. Alternatively, each end of the central electrode of the balanced port may be electrically connected to a balanced input terminal via a matching capacitor, a matching capacitor may be electrically connected between the balanced input terminals, or a matching capacitor may be electrically connected between each of the balanced input terminals and the ground.

In addition, the width of the central electrode of the balanced port may differ from the widths of the remaining central electrodes. With this arrangement, an optimum impedance match can be obtained between the nonreciprocal circuit device and the balanced output circuit. Especially when the impedance of the balanced output circuit is low, the width of the central electrode of the balanced port may be set broader than the widths of the remaining central electrodes. Consequently, conductive loss at the central conductors can be reduced and thereby low insertion loss can be obtained in the nonreciprocal circuit device.

According to a second aspect of the present invention, there is provided a communication apparatus including the nonreciprocal circuit device of the invention and a pair of amplifiers driven with a phase difference of approximately 180 degrees. In the communication apparatus, the balanced port of the nonreciprocal circuit device is connected to the output side of the pair of amplifiers.

Other features and advantages of the present invention will become apparent from the following description of embodiments of the invention which refers to the accompanying drawings.

DESCRIPTION OF EMBODIMENTS OF THE INVENTION

Figure 1:
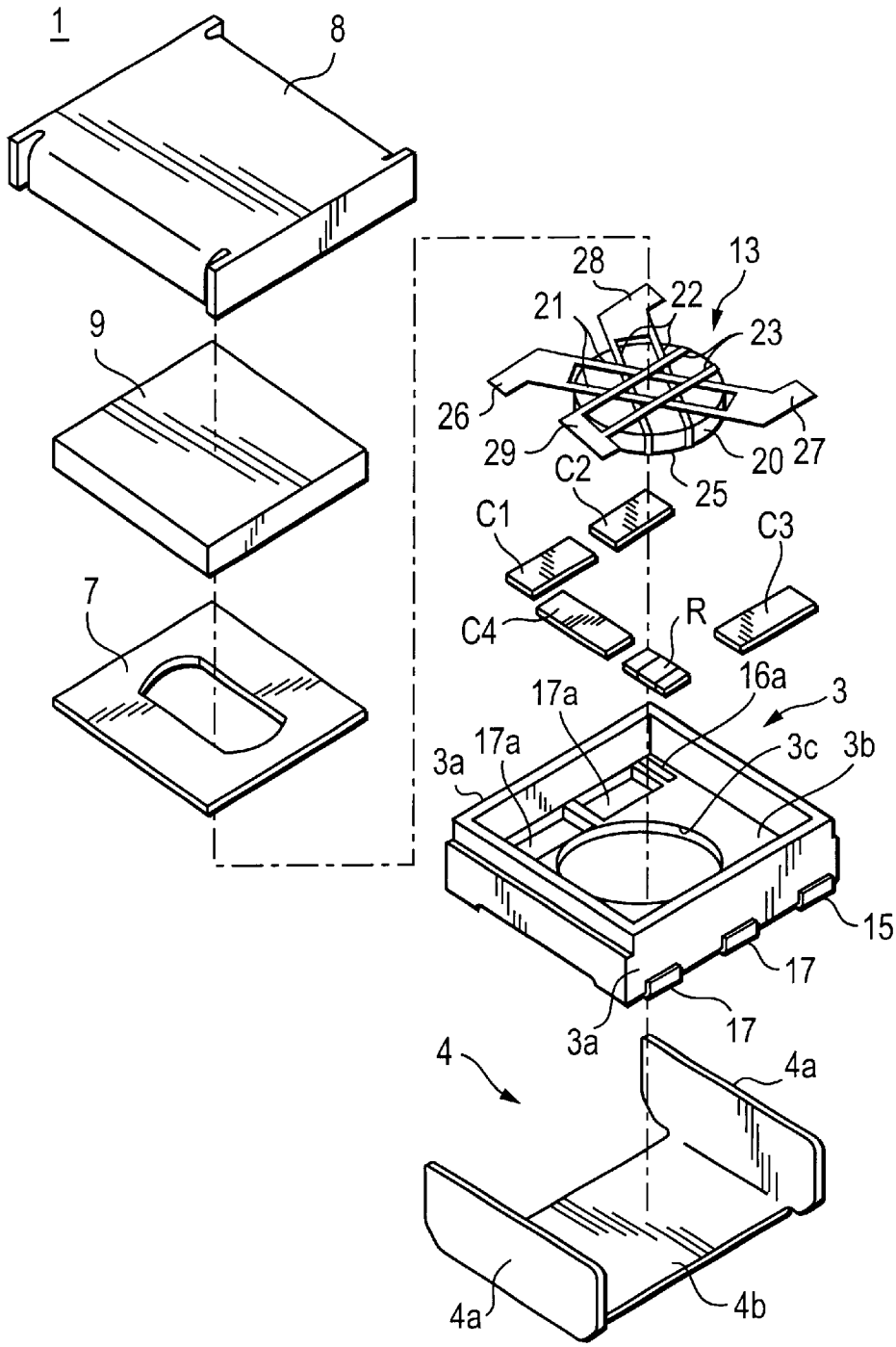
FIG. 1 is an exploded perspective view of a nonreciprocal circuit device according to an embodiment of the present invention.

Now, referring to the attached drawings, a description will be given of several embodiments of a nonreciprocal circuit device and a communication apparatus according to the present invention. In each of the embodiments, a lumped constant isolator will be described as an example of the nonreciprocal circuit device of the invention. The same reference numerals will be given to the same components and parts shown in the embodiments and the explanation thereof will be omitted.

[First Embodiment: FIGS. 1 to 6]

As shown in FIG. 1, an isolator 1 substantially includes a metal lower case 4, a resin terminal case 3, a central electrode assembly 13, a metal upper case 8, a permanent magnet 9, an insulating member 7, a resistor R, matching capacitors C1 to C4, and the like.

The central electrode assembly 13 is arranged in such a manner that central electrodes 21 to 23 intersect each other at an angle of approximately 120 degrees in a mutually electrically insulated manner on the upper surface of a disk-shaped microwave ferrite member 20. The central electrode 22 has a connecting portion 28 at one end thereof and the central electrode 23 has a connecting portion 29 at one end thereof. A ground electrode 25 is connected to the other ends of the central electrodes 22 and 23. The ground electrode 25 common to the central electrodes 22 and 23 is arranged in a manner substantially covering the lower surface of the ferrite member 20.

On the other hand, the central electrode 21 has respective connecting portions 26 and 27 at the ends thereof. In the central electrode assembly 13, the ground electrode 25 disposed on the back of the ferrite member 20 is grounded to a bottom wall 4*b* of the metal lower case 4 by soldering or the like via a window 3*c* of the resin terminal case 3.

Figure 2:
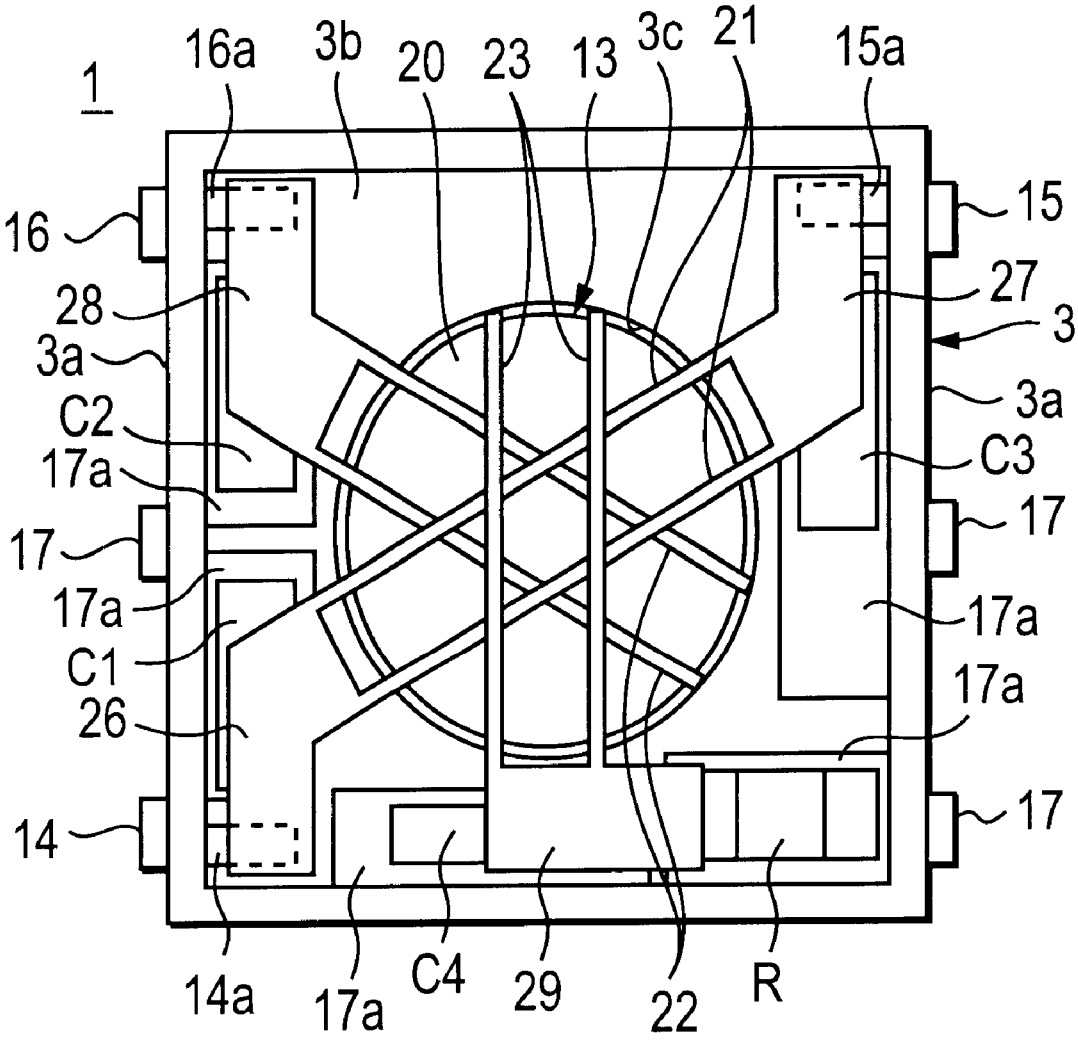
FIG. 2 is a plan view showing the inside of the nonreciprocal circuit device shown in FIG. 1.

As shown in FIG. 2, in the resin terminal case 3, balanced input terminals (differential input terminals) 14 and 15, an unbalanced output terminal 16, and three ground terminals 17 are insert-molded. One end of each of these terminals 14 to 17 is led out from one of two mutually facing side walls 3*a* of the resin terminal case 3 and the other ends thereof are exposed at a bottom 3*b* of the resin terminal case 3 to form balanced input leading electrode portions 14*a* and 15*a*, an unbalanced output leading electrode portion 16*a*, and a ground leading electrode portion 17*a*. The balanced input leading electrode portions 14*a* and 15*a* and the unbalanced output leading electrode portion 16*a* are soldered to the connecting portions 26, 27, and 28 of the central electrodes 21 and 22.

Figure 3:
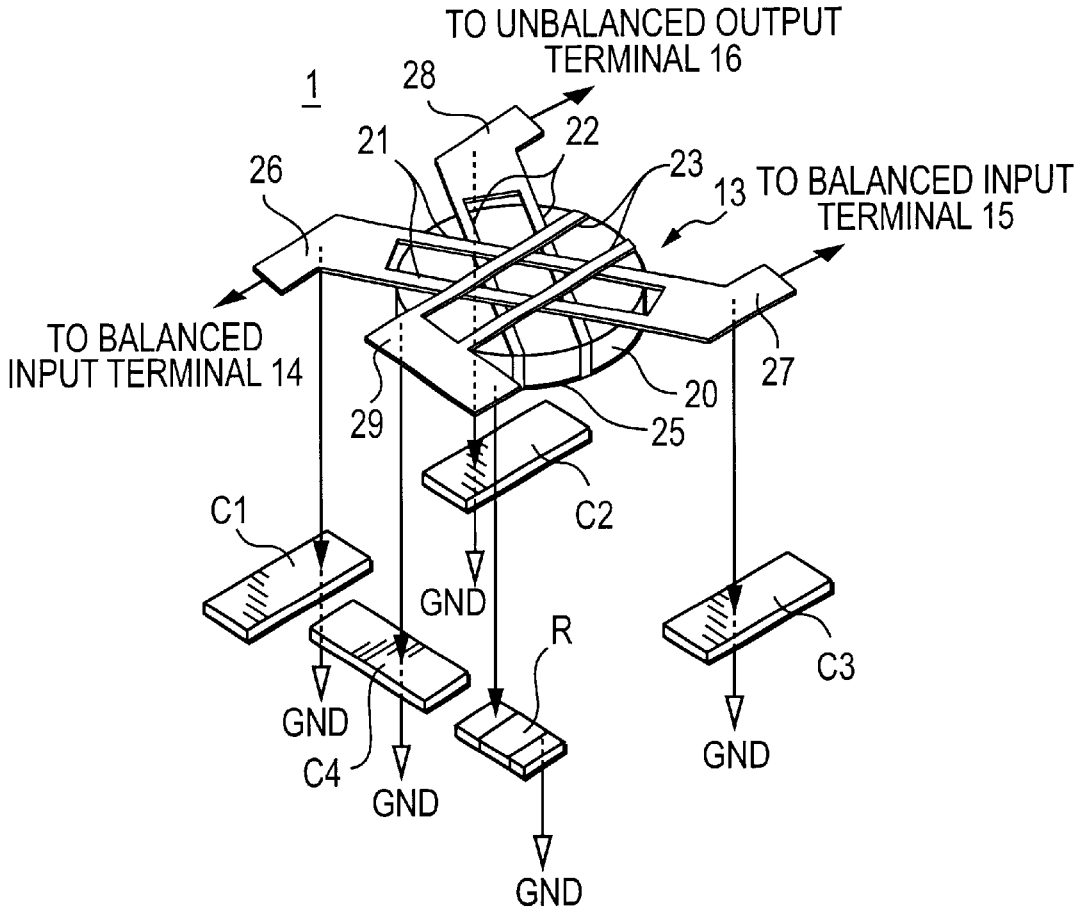
FIG. 3 is a schematic structural view illustrating the connections between components inside the nonreciprocal circuit device shown in FIG. 1.

Regarding the matching capacitors C1 to C4, the hot-side capacitor electrodes thereof are soldered to the connecting portions 26 to 29 of the central electrodes 21 to 23, and the cold-side capacitor electrodes thereof are soldered to the ground leading electrode portion 17*a* exposed on the resin terminal case 3. One end of the resistor R is connected to the hot-side capacitor electrode of the matching capacitor C4 via the connecting portion 29 of the central electrode 23 and the other end thereof is connected to the ground leading electrode portion 17*a* exposed on the bottom 3*a* of the resin terminal case 3. In other words, the matching capacitor C4 and the resistor R are electrically connected in parallel between the connecting portion 29 of the central electrode 23 and the ground. FIG. 3 shows the inside electrical connections of the isolator 1.

The components arranged as described above are, for example, assembled as follows. As shown in FIG. 1, the metal lower case 4 is attached to the lower part of the resin terminal case 3. Next, inside the resin terminal case 3, the central electrode assembly 13, the matching capacitors C1 to C4, the resistor R, and the like are contained, and then the metal upper case 8 is attached thereto. The permanent magnet 9 and the insulating member 17 are interposed between the metal upper case 8 and the central electrode assembly 13. The permanent magnet 9 applies a DC magnetic field H to the central electrode assembly 13. The lower case 4 and the upper case 8 serve as yokes and are bonded with each other to constitute a complete metal case so as to form a magnetic circuit.

Figure 4:
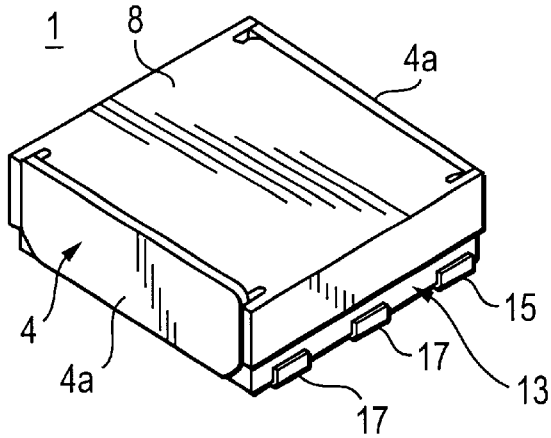
FIG. 4 is an external perspective view of the nonreciprocal circuit device shown in FIG. 1.
Figure 5:
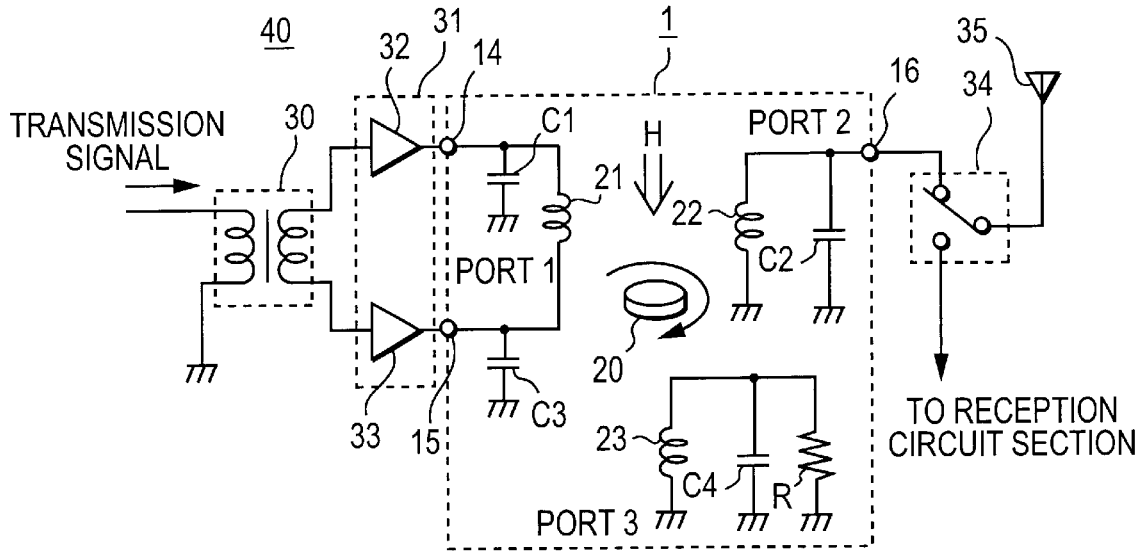
FIG. 5 is an electrical circuit diagram illustrating a transmission circuit section of a communication apparatus in which the nonreciprocal circuit device shown in FIG. 1 is connected to a balanced output circuit.

With the above arrangement, the isolator 1 as shown in FIG. 4 is formed. FIG. 5 is an electric circuit diagram in which the isolator 1 is incorporated in a transmission circuit section of a mobile phone 40. In FIG. 5, reference numeral 30 denotes a balun, reference numeral 31 denotes a push-pull amplifier having a pair of amplifiers 32 and 33 driven with a phase difference of 180 degrees. Reference numeral 34 denotes an antenna switch and reference numeral 35 denotes an antenna element.

Both ends of the central electrode 21 of the isolator 1, specifically, the connecting portions 26 and 27, serve as feeding ends. An input port 1 connected to the central electrode 21 serves as a balanced input port. The balanced input port 1 connected to the central electrode 21 of the isolator 1 is electrically connected to the balanced output side of the push-pull amplifier 31. An output port 2 connected to the central electrode 22 of the isolator 1 serves as an unbalanced output port. The unbalanced output port 2 is electrically connected to the antenna switch 34. A port 3 connected to the central electrode 23 of the isolator 1 serves as a terminating port.

The isolator 1 can be connected to the output side of the push-pull amplifier 31 (balanced output circuit) without interposing a balun, a hybrid circuit, or the like therebetween. Thus, the transmission circuit section can be made compact and can be produced at low cost. Since it is unnecessary to dispose a balun, a hybrid circuit, or the like, in the mobile phone 40, insertion loss and unnecessary radiation can be reduced and its usable frequency band can be broadened.

In addition, by adjusting the capacitance values of the matching capacitors C1 and C3 electrically connected between the portions 26 and 27 at each end of the central electrode 21 of the balanced input port 1 and the ground, the operational central frequency of the transmission circuit section can be set to tune in on a target frequency. In this case, since the ends of the central electrode 21 are not electrically connected to each other via a capacitor, no lead wire or the like generates an unnecessary parasitic inductance component.

In addition, preferably, each of the central electrodes 21 to 23 has an electric length of ½ wavelength. When the central electrode 21 of the balanced port 1 has the electric length of ½ wavelength, the impedance between the connecting portions 26 and 27 at each end of the central electrode 21 becomes infinite. In other words, it becomes unnecessary to connect a matching capacitor to the central electrode 21 when the central electrode 21 has the electric length of ½ wavelength. In addition, when the central electrode 21 has almost the electric length of ½ wavelength, comparatively low impedance capacitors can be used as matching capacitors C1 and C3 and thereby the operational frequency band of the isolator can be broadened.

Figure 6:
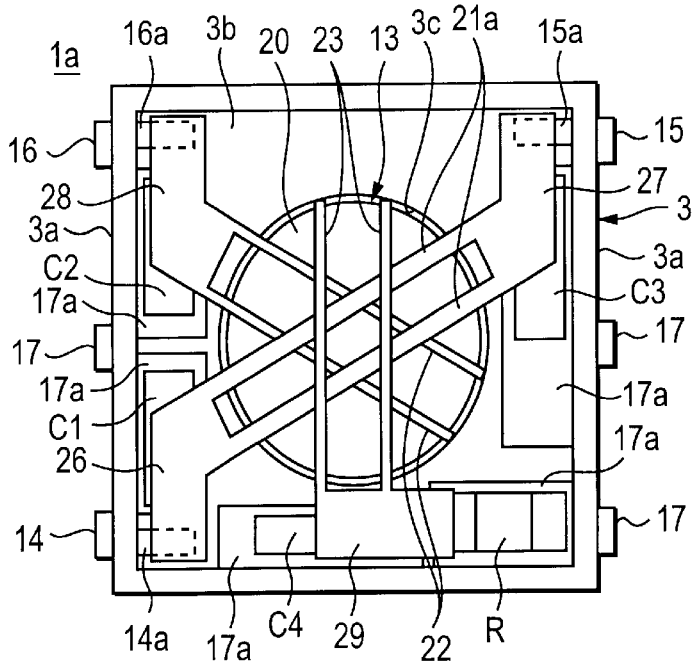
FIG. 6 is a plan view showing the inside of a modification of the nonreciprocal circuit device shown in FIG. 1.

In addition, when the width of the conductors in a central electrode 21*a* of the balanced input port 1 is made different from the widths of the conductors in the other central electrodes 22 and 23, as in an isolator la shown in FIG. 6, an optimum impedance match can be obtained between the isolator 1 and the push-pull amplifier 31. Especially, when the impedance of the push-pull amplifier 31 is low, the conductor width of the central electrode 21*a* of the balanced input port 1 is set to be broader than the conductor widths of the other central electrodes 22 and 23. With this arrangement, a conductive loss at the central electrode 21*a* is reduced and therefore insertion loss can be reduced in the isolator 1*a*.

In addition, in the push-pull amplifier 31, it is characteristically found that hardly any second harmonic wave occurs (example: approximately 40 to 50 dB down from the fundamental wave). Thus, the problem to be solved here is how to suppress a third harmonic wave (approximately 40 dB down from the fundamental wave). On the other hand, the isolator 1 can significantly suppress the third harmonic wave. Thus, by combining the push-pull amplifier 31 with the isolator 1, both the second and third harmonic waves can be sufficiently suppressed below 60 dB with respect to the fundamental wave without adding a filter or a balun.

Table 1 shows measurements of the levels of suppression of the second and third harmonic waves and insertion loss when the push-pull amplifier 31 is combined with the isolator 1. For comparison, there are additionally shown measurements obtained by combining an unbalanced amplifier with an isolator of the related art and measurements obtained by combining the unbalanced amplifier, the isolator of the related art, and a low pass filter. In this manner, while preventing the emission of unnecessary harmonic waves, the cost, the dimensions, and the weight can be reduced. With the reduction of insertion loss, a communication apparatus with low power consumption can be obtained. In a mobile communication apparatus, miniaturization, weight and cost reduction, and long battery life can be achieved.

TABLE 1

| | |
|---|---|
| 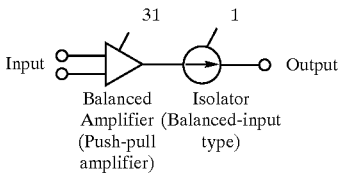 | Second harmonic wave: −65 dB<br>Third harmonic wave: −75 dB<br>Insertion loss: 0.35 dB |
| 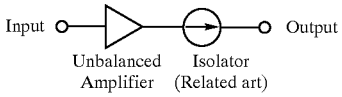 | Second harmonic wave: −50 dB<br>Third harmonic wave: −75 dB<br>Insertion loss: 0.35 dB |
| 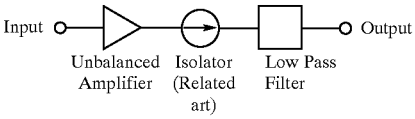 | Second harmonic wave: −60 dB<br>Third harmonic wave: −90 dB<br>Insertion loss: 0.45 dB |

Figure 7:
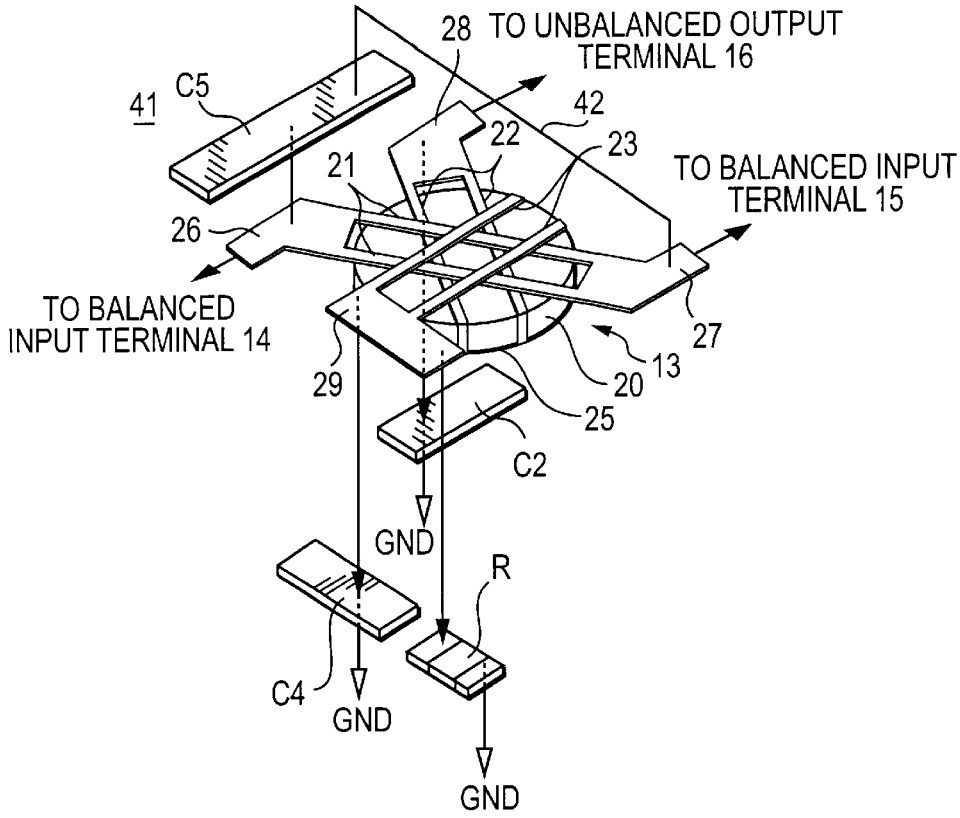
FIG. 7 is a schematic structural view of a nonreciprocal circuit device according to another embodiment of the present invention.
Figure 8:
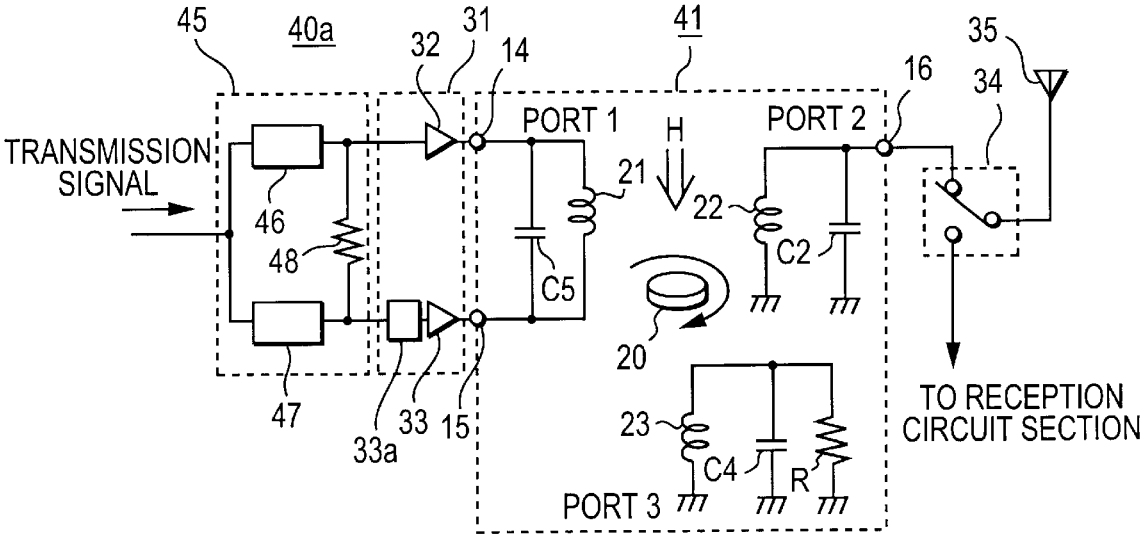
FIG. 8 is an electric circuit diagram illustrating a transmission circuit section of a communication apparatus in which the nonreciprocal circuit device shown in FIG. 7 is connected to a balanced output circuit.

[Second Embodiment: FIGS. 7 and 8]

FIG. 7 shows the inside electric connections of an isolator 41 according to a second embodiment of the present invention. In matching capacitors C2 and C4, the hot-side capacitor electrodes thereof are soldered respectively to connecting portions 28 and 29 of central electrodes 22 and 23 and the cold-side capacitor electrodes thereof are soldered to a ground leading electrode 17*a*. In a matching capacitor C5, the lower-surface capacitor electrode thereof is soldered to the connecting portion 26 of the central electrode 21 and the upper-surface capacitor electrode thereof is electrically connected to the connecting portion 27 via a lead wire 42.

One end of the resistor R is connected to the hot-side capacitor electrode of the matching capacitor C4 via the connecting portion 29 of the central electrode 23 and the other end thereof is connected to the ground leading electrode portion 17*a*.

FIG. 8 shows an electric circuit diagram in which the isolator 41 is incorporated in the transmission circuit section of a mobile phone 40*a*. In FIG. 8, reference numeral 45 denotes a power distribution unit having distributed constant lines (strip lines) 46 and 47 and a resistor 48. Both ends of the central electrode 21 of the isolator 41, specifically, the connecting portions 26 and 27, serve as feeding ends. An input port 1 connected to the central electrode 21 is a balanced input port. The balanced input port 1 connected to the central electrode 21 of the isolator 41 is electrically connected to the balanced output side of the push-pull amplifier 31. A phase shifter 33*a* is connected in series to an amplifier 33 of the push-pull amplifier 31.

The isolator 41 can be connected directly to the output side of the push-pull amplifier 31 (balanced output circuit) without interposing a balun or a hybrid therebetween. Thus, the transmission circuit section can be made compact and low-priced. Additionally, since a balun, a hybrid, or the like can be omitted, in the mobile phone 40*a*, insertion loss and unnecessary radiation can be reduced and the usable frequency band can be broadened.

In addition, by adjusting the capacitance value of the matching capacitor C5 electrically connected between both ends of the central electrode 21 of the balanced input port 1, the operational central frequency of the transmission circuit section can be tuned in on a target frequency.

Figure 9:
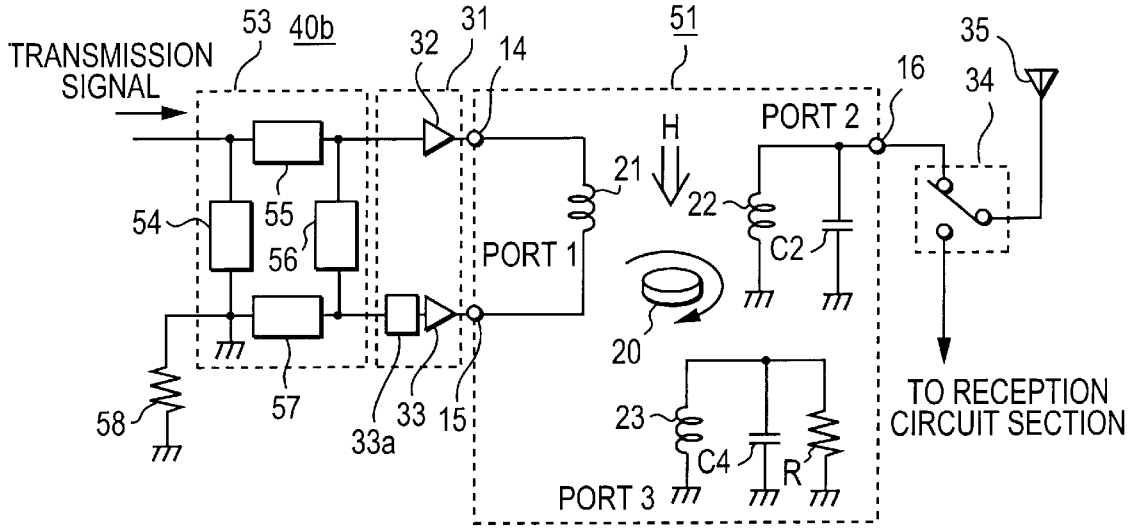
FIG. 9 is an electric circuit diagram of a communication apparatus including a nonreciprocal circuit device according to another embodiment of the present invention.

[Third Embodiment: FIG. 9]

FIG. 9 shows an electric circuit diagram in which an isolator 51 according to a third embodiment of the invention is incorporated in the transmission circuit section of a mobile phone 40*b*. In FIG. 9, reference numeral 53 denotes a hybrid circuit having distributed constant lines (strip lines) 54 to 57 and reference numeral 58 denotes a terminating resistor. Both ends of a central electrode 21 of the isolator 51, specifically, the portions 26 and 27, serve as feeding ends. An input port 1 connected to the central electrode 21 is a balanced input port. In the isolator 51, since no matching capacitor is connected to the central electrode 21, the isolator 51 can be further miniaturized.

[Fourth to Ninth Embodiments: FIGS. 10 to 15]

Figure 10:
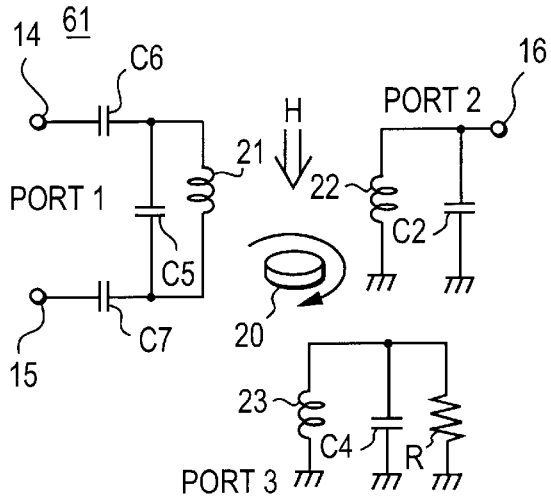
FIG. 10 is an electrically equivalent circuit diagram of a nonreciprocal circuit device according to another embodiment of the present invention.

FIG. 10 shows an electrically equivalent circuit diagram of an isolator 61 according to a fourth embodiment of the present invention. In an isolator 61, both ends of a central electrode 21 serve as feeding ends, and a port 1 connected to the central electrode 21 serves as a balanced input port. A matching capacitor C5 is electrically connected between the ends of the central electrode 21. Each of matching capacitors C6 and C7 is electrically connected in series to a respective end of the central electrode 21. The operational central frequency of the transmission circuit section can be tuned in on a target frequency by appropriately adjusting the capacitance values of the matching capacitors C5 to C7. Furthermore, impedance matching can be obtained between the isolator and a balanced output circuit whose output impedance significantly deviates from 50 ohms.

Figure 11:
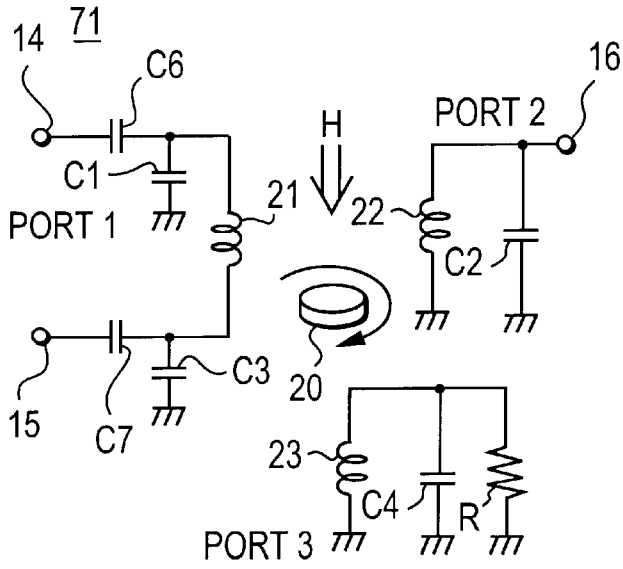
FIG. 11 is an electrically equivalent circuit diagram of a nonreciprocal circuit device according to another embodiment of the present invention.

FIG. 11 is an electrically equivalent circuit diagram of an isolator 71 according to a fifth embodiment of the present invention. In the isolator 71, both ends of a central electrode 21 are feeding ends and each of matching capacitors C1 and C3 is electrically connected between a respective end of the central electrode 21 and a ground. Matching capacitors C6 and C7 are electrically connected in series to respective ends of the central electrode 21. The capacitance values of the capacitors C1, C3, C6, and C7 are appropriately adjusted, with the result that the operational central frequency of the transmission circuit section can be tuned in on a target frequency. In addition, impedance matching can be obtained between the isolator and a balanced output circuit whose output impedance significantly deviates from 50 ohms.

Figure 12:
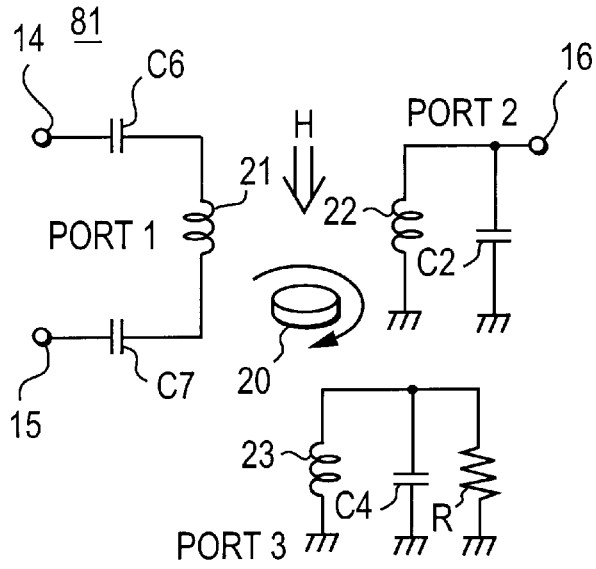
FIG. 12 is an electrically equivalent circuit diagram of a nonreciprocal circuit device according to another embodiment of the present invention.

FIG. 12 is an electrically equivalent circuit diagram of an isolator 81 according to a sixth embodiment of the present invention. In the isolator 81, a central electrode 21 has both ends serving as feeding ends. Matching capacitors C6 and C7 are electrically connected between respective ends of the central electrode 21 and balanced input terminals 14 and 15. By appropriately adjusting the capacitance values of the matching capacitors C6 and C7, impedance matching can be obtained between the isolator and the balanced output circuit having a low output impedance (for example, 10 ohms or less).

Figure 13:
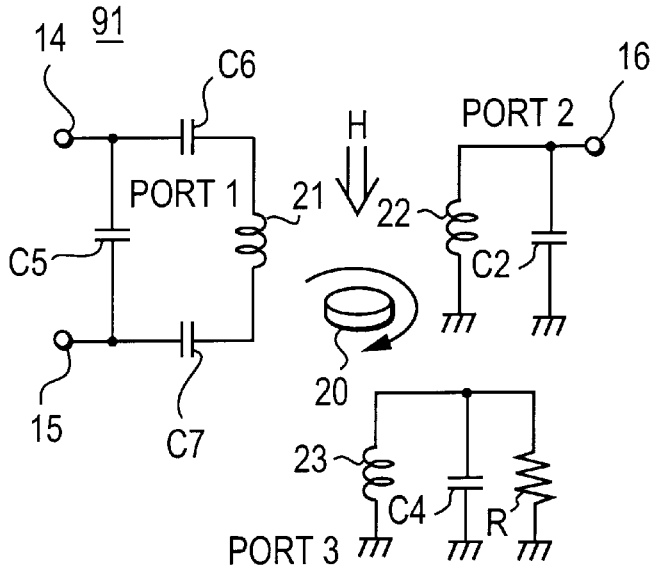
FIG. 13 is an electrically equivalent circuit diagram of a nonreciprocal circuit device according to another embodiment of the present invention.

FIG. 13 is an electrically equivalent circuit diagram of an isolator 91 according to a seventh embodiment of the present invention. In the isolator 91, both ends of a central electrode 21 are feeding ends. Matching capacitors C6 and C7 are electrically connected respectively between ends of the central electrode 21 and balanced input terminals 14 and 15. In addition, a matching capacitor C5 is electrically connected between the balanced input terminals 14 and 15. By appropriately adjusting the capacitance values of the matching capacitors C5 to C7, the operational central frequency of the transmission circuit section can be tuned in on a target frequency. Additionally, impedance matching can be obtained between the isolator and a balanced output circuit whose output impedance greatly deviates from 50 ohms.

Figure 14:
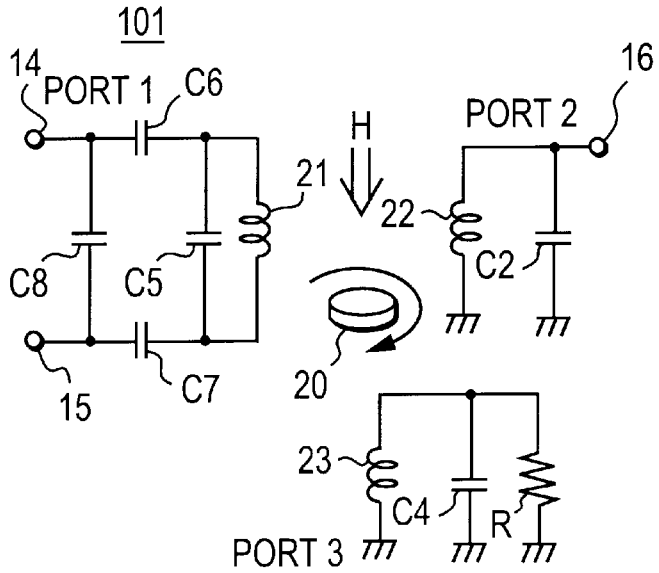
FIG. 14 is an electrically equivalent circuit diagram of a nonreciprocal circuit device according to another embodiment of the present invention.
Figure 15:
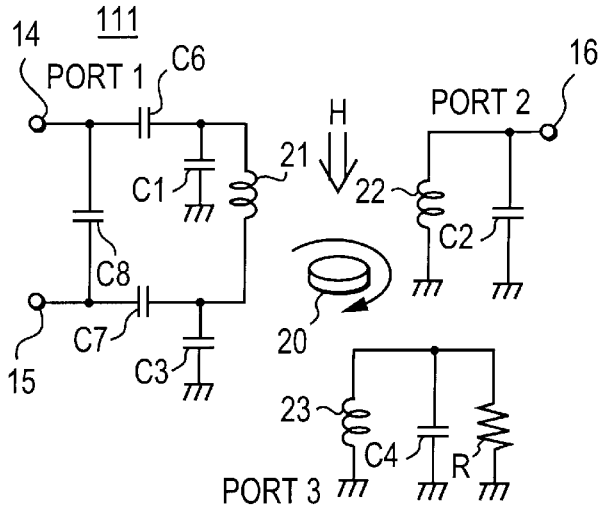
FIG. 15 is an electrically equivalent circuit diagram of a nonreciprocal circuit device according to another embodiment of the present invention.

FIG. 14 is an electrically equivalent circuit diagram of an isolator 101 according to an eighth embodiment of the present invention. In the isolator 101, in addition to the structure of the isolator 61 of the fourth embodiment shown in FIG. 10, a matching capacitor C8 is electrically connected between balanced input terminals 14 and 15. Furthermore, FIG. 15 is an electrically equivalent circuit diagram of an isolator 111 according to a ninth embodiment of the present invention. In the isolator 111, in addition to the structure of the isolator 71 of the fifth embodiment shown in FIG. 11, a matching capacitor C8 is electrically connected between balanced input terminals 14 and 15.

[Other Embodiments]

The nonreciprocal circuit device and the communication apparatus according to the present invention are not restricted to the above embodiments and can be modified variously within the scope of the invention. For example, in each of the above embodiments, the nonreciprocal circuit device is a lumped constant isolator having one port terminated. However, the present invention can be applied to other kinds of high frequency components such as a lumped constant circulator having three ports.

Furthermore, the central electrodes and matching capacitors may be formed on a surface of a dielectric substrate or a magnetic substrate by pattern printing or the like. Alternately, inside a multilayer substrate formed by laminating dielectric sheets or magnetic sheets, they may be formed by stacked portions of the dielectric and/or magnetic sheets by pattern printing or the like. When the central electrodes are formed on a magnetic substrate or a magnetic multilayer substrate formed by stacking magnetic sheets, the ferrite member and the central electrodes may be integrated with each other.

Figure 16:
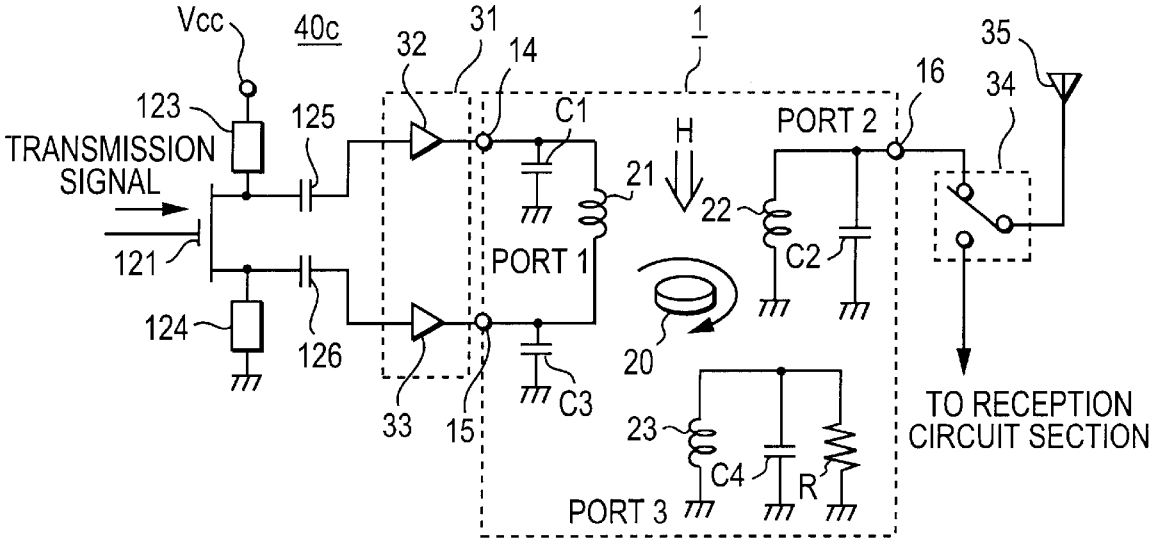
FIG. 16 is an electric circuit diagram of the transmission circuit section of a communication apparatus according to another embodiment of the invention, in which the nonreciprocal circuit device shown in FIG. 1 is connected to a balanced output circuit.

In addition, the communication apparatus according to the present invention is not restricted to the above embodiments. For example, FIG. 16 is an electric circuit diagram in which the isolator 1 of the first embodiment is incorporated in the transmission circuit section of a mobile phone 40*c*. In FIG. 16, there are shown a power supply terminal Vcc, an FET (or a transistor) 121, impedance elements (such as resistors) 123 and 124, capacitors 125 and 126, a push-pull amplifier 31 having a pair of amplifiers 32 and 33 driven with a phase difference of 180 degrees, an antenna switch 34, and an antenna element 35.

Both ends of a central electrode 21 of the isolator 1, specifically, connecting portions 26 and 27, are feeding ends. An input port 1 connected to the central electrode 21 is a balanced input port. The balanced input port 1 connected to the central electrode 21 of the isolator 1 is electrically connected to the balanced output side of the push-pull amplifier 31. An output port 2 connected to the central electrode 22 of the isolator 1 is an unbalanced output port. The unbalanced output port 2 is electrically connected to the antenna switch 34. A port 3 connected to the central electrode 23 of the isolator 1 is a terminating port.

Figure 17:
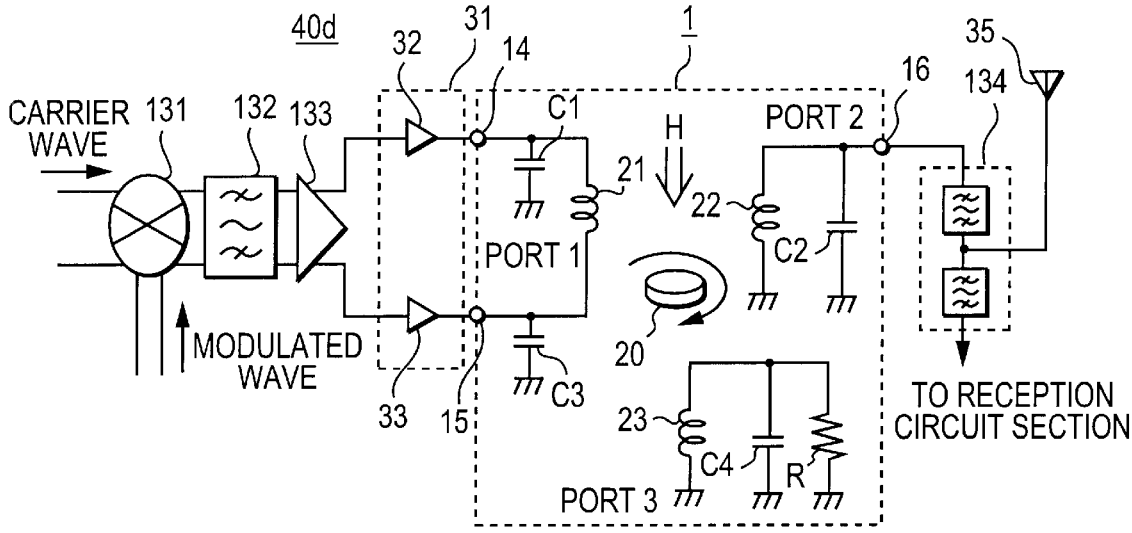
FIG. 17 is an electric circuit diagram of the transmission circuit of a communication apparatus according to another embodiment of the invention, in which the nonreciprocal circuit device shown in FIG. 1 is connected to a balanced output circuit.

FIG. 17 is an electric circuit diagram in which the isolator 1 of the first embodiment is incorporated in the transmission circuit section of a mobile phone 40*d*. In FIG. 17, there are shown a balanced mixer 131, a balanced filter (such as a surface acoustic wave filter) 132, a balanced amplifier 133, a push-pull amplifier 31 having a pair of amplifiers 32 and 33 driven with a phase difference of 180 degrees, an antenna duplexer 134, and an antenna element 35. The balanced mixer 131 mixes a modulation signal or a modulated RF signal with a carrier wave or a local signal.

As described above, in the present invention, at least one of the ports connected to the plurality of central electrodes is a balanced port. Thus, when the nonreciprocal circuit device is connected to the output side of the balanced output circuit, the device can be connected without interposing a balun, a hybrid circuit, or the like. In addition, by making the conductor width of the central electrode of the balanced port different from the widths of the other central electrodes, an optimum impedance match can be obtained between the nonreciprocal circuit device and the balanced output circuit. Especially, when the impedance of the balanced output circuit is low, by setting the width of the central electrode of the balanced port to be broader than the widths of the other central electrodes, conductive loss at the central electrodes can be reduced, with the result that the nonreciprocal circuit device can have low insertion loss. Accordingly, in the communication apparatus of the invention, production cost, insertion loss, and unnecessary radiation can be suppressed, and miniaturization can be achieved while having good frequency characteristics.

Further, by combining the balanced-type amplifier with the balanced-input type isolator according to the present invention, without adding a filter or a balun, second and third harmonic waves can be sufficiently suppressed below 60 dB with respect to the fundamental wave. As a result, while preventing the emission of unnecessary harmonic waves, the cost, the dimensions, and the weight can be reduced. With the reduction of insertion loss, a communication apparatus of low power consumption type can be produced. In a mobile communication apparatus, the reduction of size, weight, and cost, and long battery life can be achieved.

What is claimed is:

1. A nonreciprocal circuit device comprising:

a plurality of ports;

a permanent magnet;

a ferrite member to which the permanent magnet applies a DC magnetic field; and a plurality of central electrodes arranged on the ferrite member and having ends which provide said ports;

wherein said ends of at least one of the plurality of central electrodes provide a balanced port.

2. The nonreciprocal circuit device according to claim 1, wherein both ends of the central electrode of the balanced port are feeding ends for receiving an input signal.

3. The nonreciprocal circuit device according to claim 1, further comprising a matching capacitor electrically connected in series to each end of the central electrode of the balanced port.

4. The nonreciprocal circuit device according to claim 1, further comprising a matching capacitor electrically connected between each end of the central electrode of the balanced port and a ground.

5. The nonreciprocal circuit device according to claim 1, further comprising a matching capacitor electrically connected between the ends of the central electrode of the balanced port.

6. The nonreciprocal circuit device according to claim 5, further comprising a respective balanced input terminal electrically connected to each end of the central electrode of the balanced port via a corresponding matching capacitor.

7. The nonreciprocal circuit device according to claim 6, further comprising a matching capacitor electrically connected between the balanced input terminals.

8. The nonreciprocal circuit device according to claim 6, further comprising a matching capacitor electrically connected between each of the balanced input terminals and the ground.

9. The nonreciprocal circuit device according to claim 1, wherein each of the central electrodes has an electric length of substantially ½ wavelength.

10. The nonreciprocal circuit device according to claim 1, wherein a conductor width of the central electrode of the balanced port differs from conductor widths of the remaining central electrodes.

11. The nonreciprocal circuit device according to claim 10, wherein the conductor width of the central electrode of the balanced port is broader than the conductor widths of the remaining central electrodes.

12. A communication apparatus comprising a pair of amplifiers driven with a phase difference of approximately 180 degrees and the nonreciprocal circuit device according to claim 1, wherein the balanced port of the nonreciprocal circuit device is connected to the output side of the pair of amplifiers.

* * * * *